US007128079B2

(12) United States Patent
Choi

(10) Patent No.: US 7,128,079 B2
(45) Date of Patent: Oct. 31, 2006

(54) WATERPROOF STRUCTURE OF TENT FLOOR LINK

(76) Inventor: Kyong Jai Choi, 312-301 Beach Apt., 29/5, 148 Namcheon-Dong, Suyoung-Ku, Pusan (KR) 613-101

( * ) Notice: Subject to any disclaimer, the term of this patent is extended or adjusted under 35 U.S.C. 154(b) by 136 days.

(21) Appl. No.: 10/799,884

(22) Filed: Mar. 15, 2004

(65) Prior Publication Data

US 2005/0172990 A1 Aug. 11, 2005

(30) Foreign Application Priority Data

Feb. 9, 2004 (KR) ..... 10-2004-0008468

(51) Int. Cl.
*E04H 15/64* (2006.01)

(52) U.S. Cl. ..... 135/119

(58) Field of Classification Search ..... 135/116, 135/118, 115, 119; 206/811; 383/108, 113; 428/351; 114/69; 220/904; 264/DIG. 80
See application file for complete search history.

(56) References Cited

U.S. PATENT DOCUMENTS 2,192,314 A * 3/1940 Izard ..... 428/348
2,661,785 A * 12/1953 Daust ..... 383/97
3,586,013 A * 6/1971 Gladden ..... 135/120.1
3,953,949 A * 5/1976 O'Sheeran ..... 52/82
4,305,414 A * 12/1981 Bareis ..... 135/116
4,625,468 A * 12/1986 Hampel ..... 52/2.24
4,665,935 A * 5/1987 Nichols ..... 135/125
5,715,854 A * 2/1998 Andrieux et al. ..... 135/94
5,820,189 A * 10/1998 Tew ..... 296/26.11
5,848,734 A * 12/1998 Melk ..... 222/175
5,964,236 A * 10/1999 Berke ..... 135/87
6,497,934 B1 * 12/2002 Mahn et al. ..... 428/57
6,681,785 B1 * 1/2004 Choi ..... 135/115
6,772,779 B1 * 8/2004 Pearcy ..... 135/96
2004/0173251 A1 * 9/2004 Cantwell ..... 135/115

FOREIGN PATENT DOCUMENTS

FR 2672075 A1 * 7/1992

* cited by examiner

*Primary Examiner*—Tamara L. Graysay
(74) *Attorney, Agent, or Firm*—Mayer, Brown, Rowe & Maw LLP

(57) ABSTRACT

The waterproof structure of the present invention comprises a first receptacle 102 which is formed by folding the corner portions of a tent fabric 101 in the inner direction of the tent; a second receptacle 113 which is formed opposite the first receptacle 102 in the contact part where the first floor link 111 which is sewn to the outer wall surface of the corner portion of the tent fabric 101 and the second floor link 112 which is sewn to the outer floor surface meet; a waterproof-coated member 121 fixed firmly to the tent fabric 101 that provides the first receptacle 102 and the second receptacle 113 by a plurality of sewing lines, after both ends are inserted into the first receptacle 102 and the second receptacle 113; and a waterproof tape 103 which is attached to the sewing line 131 sewn to the first receptacle 102 while shielding the inner surface of the tent fabric 101.

1 Claim, 7 Drawing Sheets

WATERPROOF STRUCTURE OF TENT FLOOR LINK

BACKGROUND OF THE INVENTION

1. Field of the Invention

The present invention relates to the tent, and more specifically to a waterproof structure of tent floor link, which can prevent rainwater or moisture from flowing into the tent from outside through the sewing line of the floor links sewn to the corner portions of the tent, by forming a first receptacle by folding in the inner direction of the tent the corner portions where the side wall of tent fabric and the floor meet, by forming a second receptacle opposite the first receptacle in the contact part where the first floor link which is sewn to the outer wall surface of the corner portion of the tent fabric and the second floor link which is sewn to the outer floor surface meet, by inserting one end and the other end of the waterproof-coated member respectively into the first receptacle and the second receptacle and fixing them by a plurality of sewing lines, and by shielding and attaching a waterproof tape from the inner surface of the tent fabric to the sewing line which is sewn to the first receptacle.

2. Description of the Related Art

How a floor link sewn to the corner portion of a tent is used in general is as shown in FIG. 1.

That is, floor links 11 and 12, which are assembled to the corner portion of the tent where pole 22 is inserted, play a role of maintaining the form of the tent, by pulling the tent fabric in many directions by the elasticity of the pole 22.

The floor links 11 and 12 sewn to the corner portion of a conventional tent have a structure as shown in FIGS. 2 to 4.

That is, the corner portions of a tent fabric 1 are folded in the outer direction of the tent to form a receptacle 2, and an auxiliary link is placed on the inner side of the receptacle 2, while two floor links 11 and 12, overlapped on the outer side of the receptacle 2, are fixed to the tent fabric 1 by the sewing line 31.

Such a structure has a problem that rainwater or moisture penetrates into the tent from outside through the sewing line part 31 which is not equipped with a waterproof device as shown by the arrow in FIG. 4.

Especially, in a conventional tent, since the inner surface of the tent fabric 1 is usually not coated, it is almost impossible to attach a waterproof tape.

And, even if the inner surface of the tent fabric 1 was coated despite the increased cost, it is very difficult to attach a waterproof tape 32 on the inner surface of the receptacle 2, because the auxiliary link 21 is fixed to the inner side of the receptacle 2 of the tent fabric 1 together by the sewing line 31.

Another problem is that even if a waterproof tape is attached, it cannot seal the space securely, so it cannot intercept rainwater or moisture flowing in from outside.

SUMMARY OF THE INVENTION

The present invention is designed in consideration of the problems of the prior art, and therefore it is an object of the present invention to provide a waterproof structure of tent floor link that can prevent rainwater or moisture from flowing into the tent from outside through the sewing line of the floor links that are sewn to the corner portions of the tent.

In accordance with the present invention, there is provided a waterproof structure of a tent floor link which is assembled to the corner portion of a tent set up with poles, comprising: a first receptacle which is formed by folding the corner portions of tent fabric in the inner direction of the tent; a second receptacle which is formed opposite said first receptacle in the contact part where a first floor link which is sewn to the outer wall surface of the corner portion of tent fabric and a second floor link which is sewn to the outer floor surface meet; a waterproof-coated member which is fixed by a plurality of sewing lines, after both ends are inserted into said first receptacle and second receptacle; and a waterproof tape which is attached to the sewing line sewn to the first receptacle while shielding the inner surface of tent fabric.

BRIEF DESCRIPTION OF THE DRAWINGS

Other objects and aspects of the present invention will become apparent from the following description of embodiments with reference to the accompanying drawings in which.

DESCRIPTION OF THE PREFERRED EMBODIMENT

Figure 1:
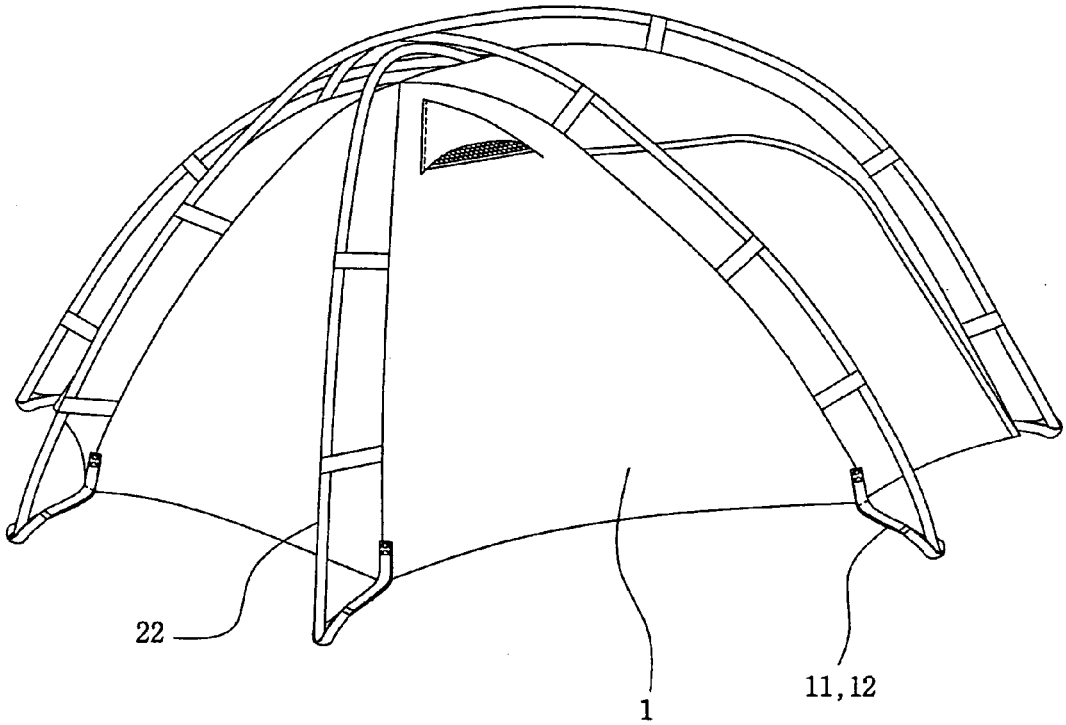
FIG. 1 PRIOR ART
FIG. 1 is a perspective view of a floor link sewn to a conventional tent.
Figure 2:
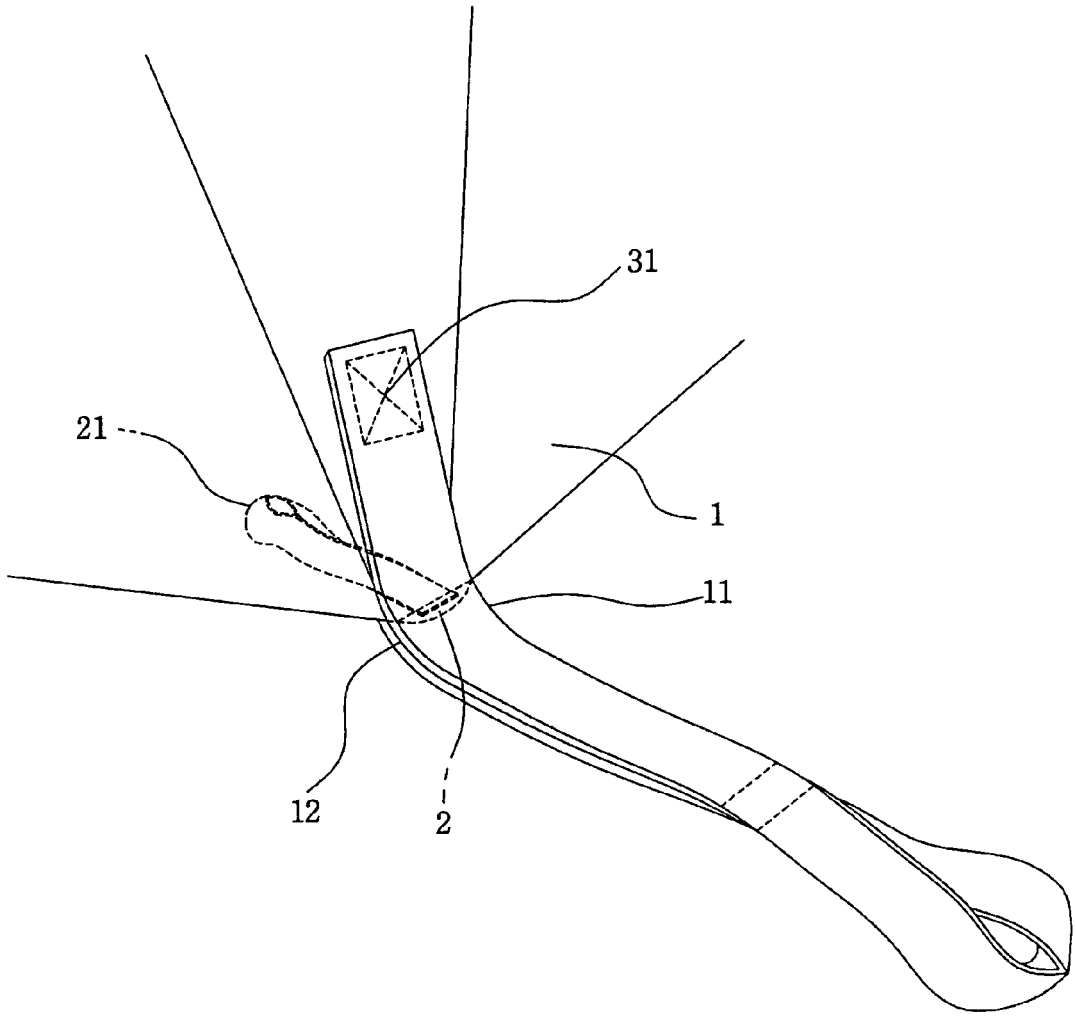
FIG. 2 PRIOR ART
FIG. 2 is a schematic perspective view showing how a floor link of a conventional tent is sewn to a corner portion of tent fabric.
Figure 3:
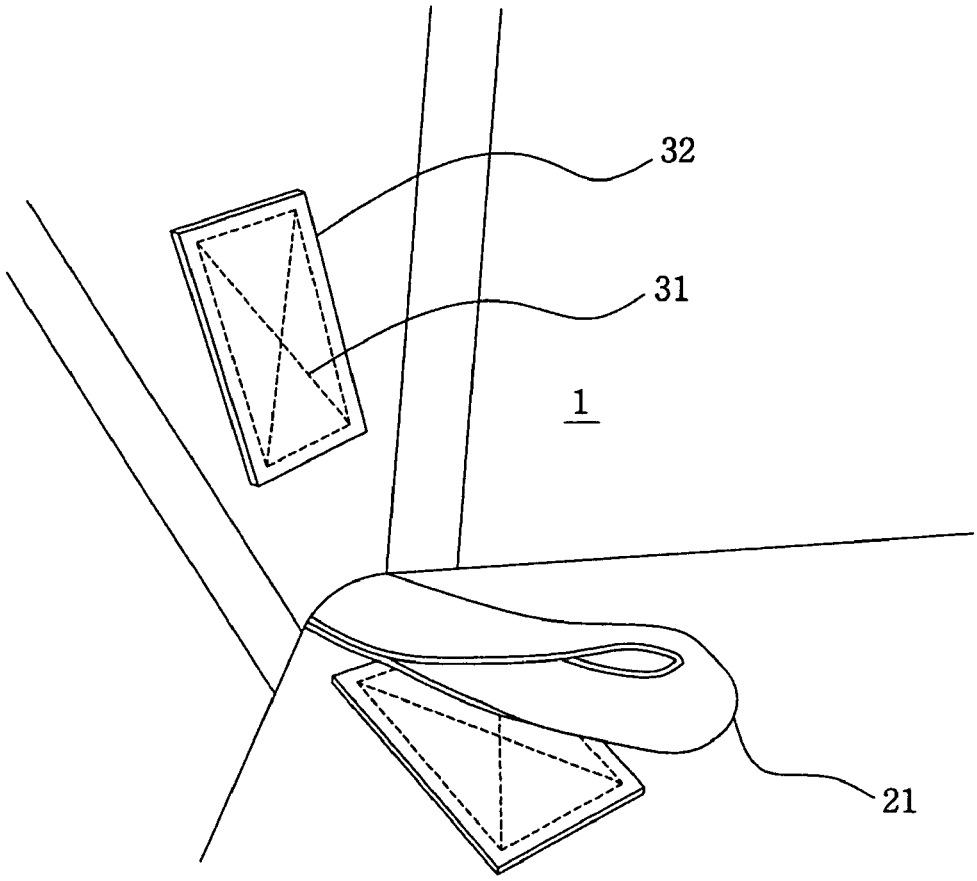
FIG. 3 PRIOR ART
FIG. 3 is a perspective view, seen from the inside of the tent, of an auxiliary link sewn together with a floor link of a conventional tent.
Figure 4:
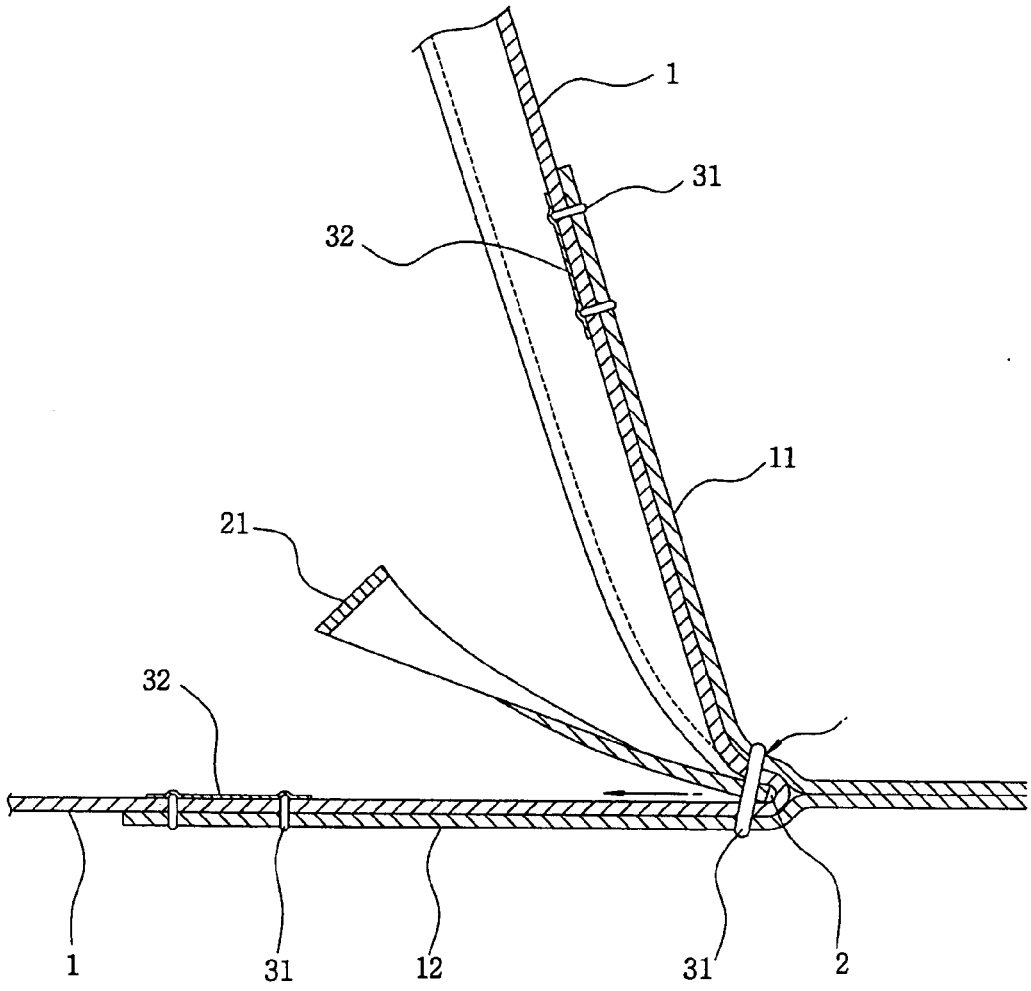
FIG. 4 PRIOR ART
FIG. 4 is a schematic cross-sectional view for describing the water leakage that appeared as the floor link of the conventional tent is sewn together with the tent fabric.
Figure 5:
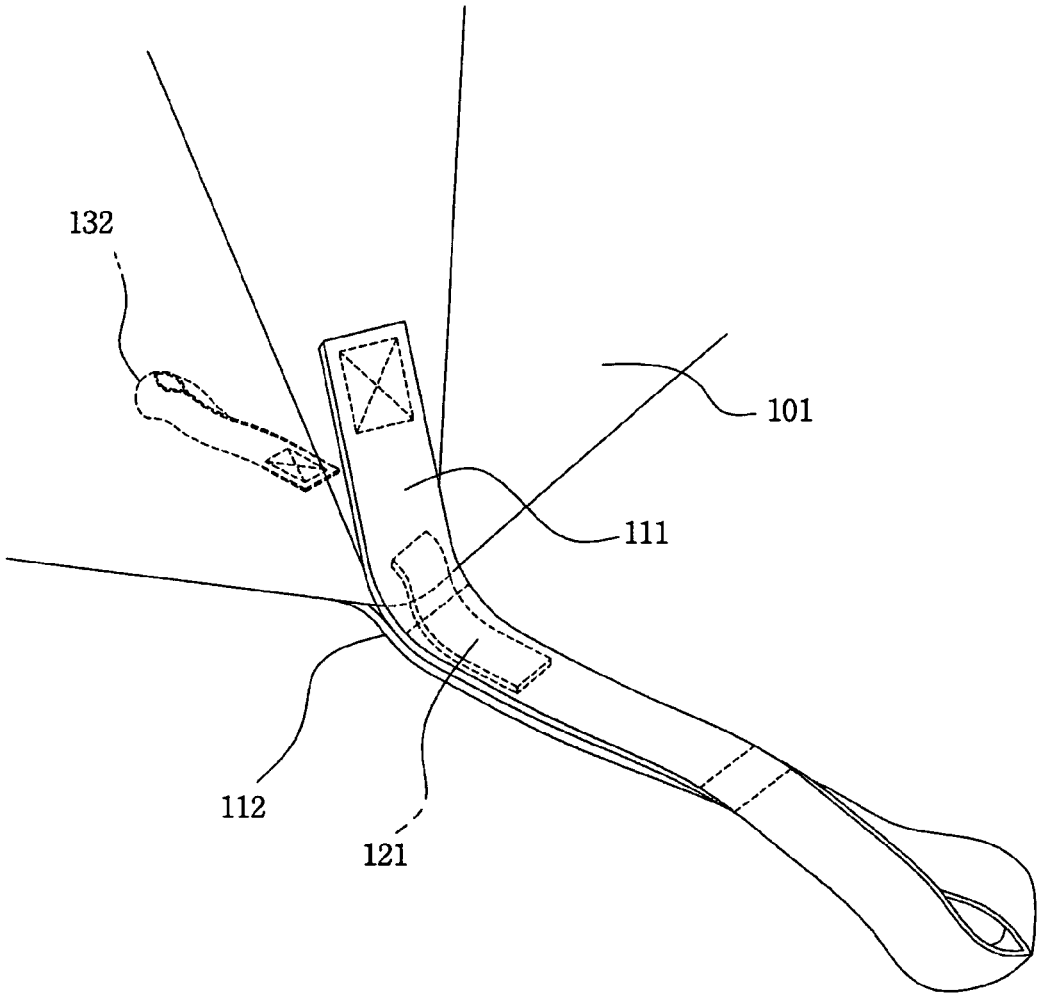
FIG. 5 is a perspective view for describing how a waterproof-coated member according to the present invention is sewn.
Figure 6:
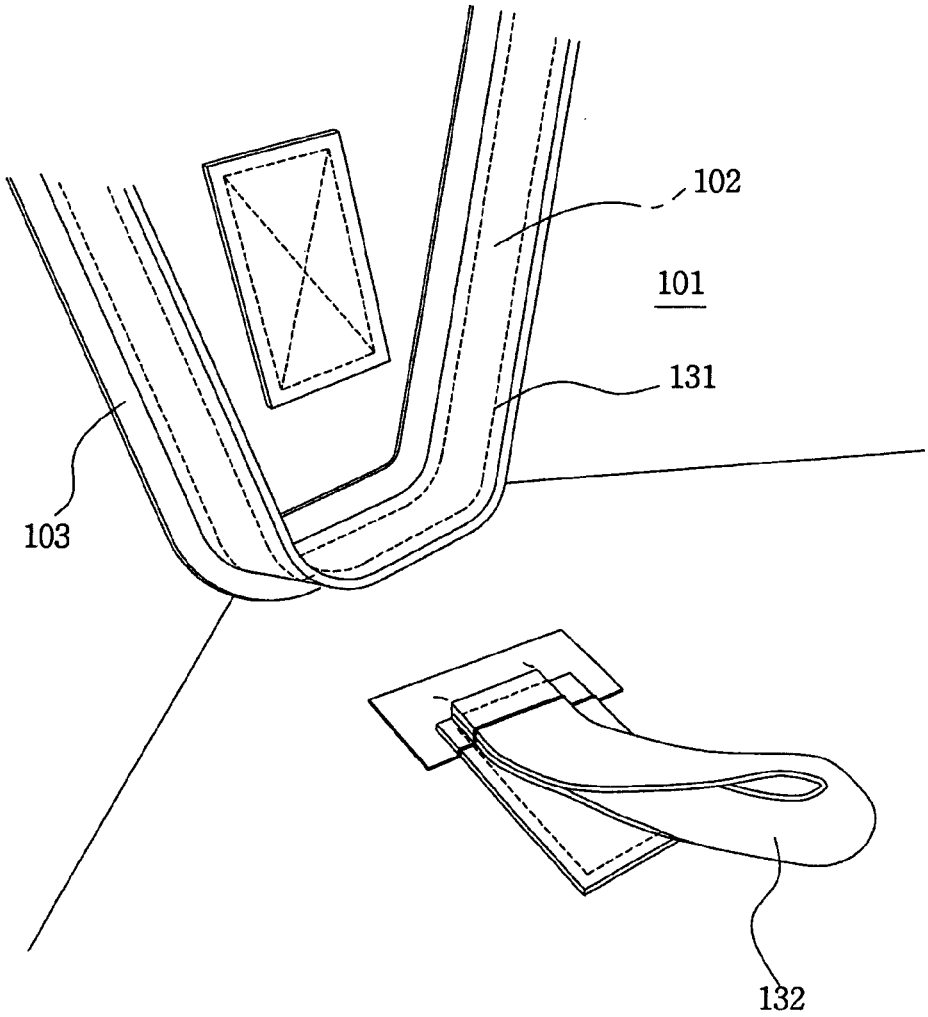
FIG. 6 is an internal perspective view showing a waterproof tape that shields the sewing line sewn to the first receptacle according to the present invention.
Figure 7:
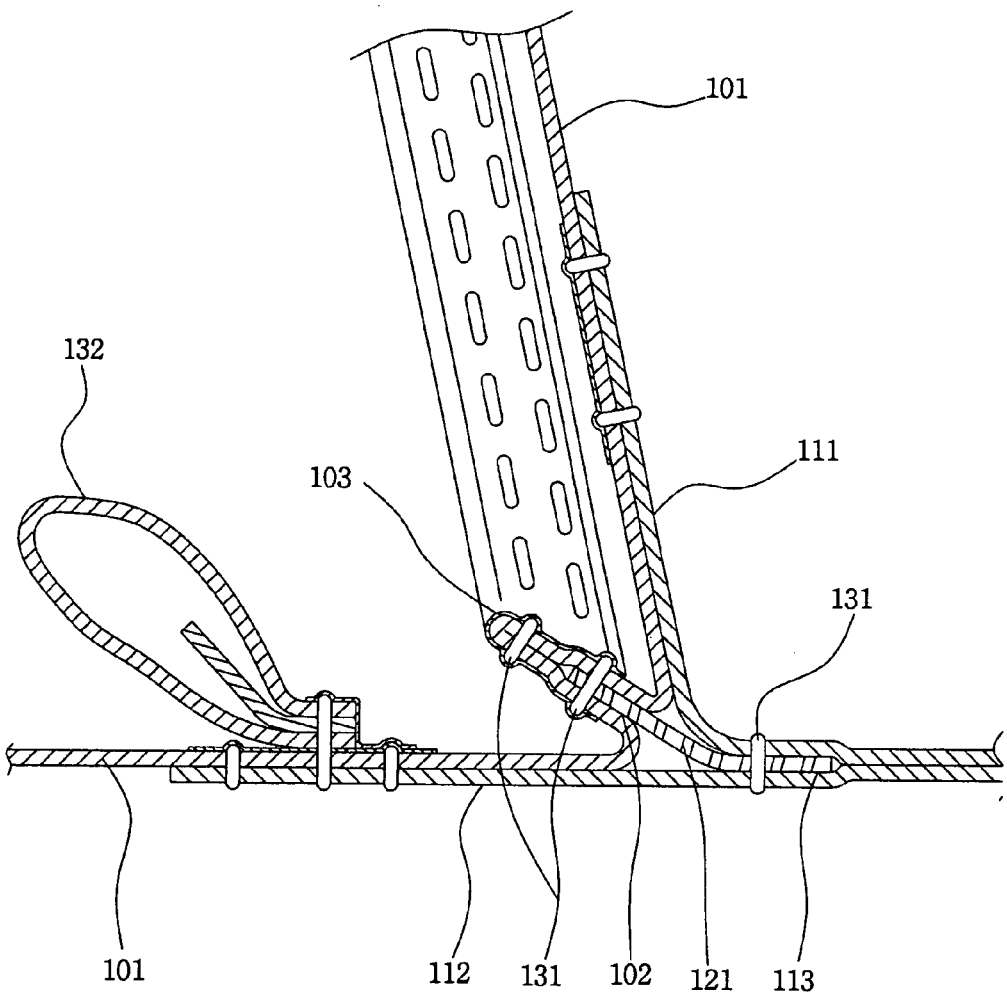
FIG. 7 is a schematic perspective view for describing the waterproof action by the waterproof-coated member of the tent according to the present invention.

Hereinafter, the present invention will be described in more detail referring to the drawings.

In the preferred embodiment of the present invention, the waterproof structure of a tent floor link which is assembled to the corner portion of the tent where a pole is set up is shown.

Looking at the schematic configuration of the waterproof structure, it comprises a first receptacle 102 which is formed by folding the corner portions of a tent fabric 101 in the inner direction of the tent; a second receptacle 113 which is formed opposite the first receptacle 102 in the contact part where the first floor link 111 which is sewn to the outer wall surface of the corner portion of the tent fabric 101 and the second floor link 112 which is sewn to the outer floor surface meet; a waterproof-coated member 121 fixed firmly to the tent fabric 101 that provides the first receptacle 102 and the second receptacle 113 by a plurality of sewing lines, after both ends are inserted into the first receptacle 102 and the second receptacle 113; and a waterproof tape 103 which is attached to the sewing line 131 sewn to the first receptacle 102 while shielding the inner surface of the tent fabric 101.

An auxiliary link 132 is sewn to the floor surface of the tent fabric 101.

The manufacturing process and the principle of operation of the waterproof structure of tent floor link of the present invention configured as mentioned above will be described below.

First, each corner portion of the tent fabric 101 is folded in the inner direction of the tent to make the first receptacle 102.

And, one end of the waterproof-coated member 121 cut to a given length is inserted into the first receptacle 102, and then the tent fabric 101 which is in contact with the surface and the reverse of one end of the waterproof-coated member 121 is sewn by the sewing line 131 to fix one end of the waterproof-coated member 121.

Also, the remnant tent fabric 101 located in the upper part of the waterproof-coated member 121 is adhered using the sewing line 131 in a mutually overlapped state.

And, to the sewing line 131 which is formed in the process of sewing the waterproof-coated member 121 to the first receptacle 102, attach the waterproof tape 103 while shielding the inner surface of the tent fabric 101. Therefore, it is possible to prevent rainwater or moisture from penetrating into the tent from outside through the sewing line 131.

Also, in the contact part where the first floor link 111 which is sewn to the outer wall surface of the corner portion of the tent fabric 101 and the second floor link 112 which is sewn to the outer floor surface meet, form the second receptacle 113 opposite the first receptacle 102. Into this second receptacle 113 is inserted the other end of the waterproof-coated member 121. Next, with the first and second floor links 111 and 112 in contact with the surface and reverse of the other end of the waterproof-coated member 121, fix the other end of the waterproof-coated member 121 by the sewing line 131.

And, since the sewing line 131 that fixes the first and second floor links 111 and 112 and the waterproof-coated member 121 has nothing to do with the water leakage in the tent, it is not absolutely necessary to attach a waterproof tape.

Since the present invention described above can perfectly prevent outside rainwater or moisture from penetrating into the tent through the sewing line of the floor link sewn to each corner portion of the tent, it can provide a more comfortable and stable tent.

What is claimed is:

1. A waterproof structure of a tent floor link which is assembled to a corner of a tent set up with poles, comprising:

a first receptacle formed by folding corner portions of tent fabric in an inner direction of the tent;

a second receptacle formed in a direction opposite to said first receptacle in a contact part formed where a first floor link sewn to an outer wall surface of one of the corner portions of tent fabric and a second floor link sewn to an outer floor surface meet;

a separate waterproof-coated member having two ends affixed by a plurality of sewing lines, wherein both ends are inserted into said first receptacle and said second receptacle, respectively; and a waterproof tape attached to the sewing line sewn to the first receptacle thereby shielding an inner surface of tent fabric from water.

* * * * *